US010041731B1

(12) United States Patent
Hinks

(10) Patent No.: US 10,041,731 B1
(45) Date of Patent: Aug. 7, 2018

(54) HVAC GRAIN DRYER

(71) Applicant: Donald E Hinks, Cape Coral, FL (US)

(72) Inventor: Donald E Hinks, Cape Coral, FL (US)

( * ) Notice: Subject to any disclaimer, the term of this patent is extended or adjusted under 35 U.S.C. 154(b) by 0 days.

(21) Appl. No.: 15/421,813

(22) Filed: Feb. 1, 2017

(51) Int. Cl.
*F26B 17/12* (2006.01)

(52) U.S. Cl.
CPC ..... *F26B 17/126* (2013.01); *F26B 2200/06* (2013.01)

(58) Field of Classification Search
CPC ..... F26B 17/126; F26B 17/12; F26B 17/22; F26B 2200/06
USPC ..... 34/165
See application file for complete search history.

(56) References Cited

U.S. PATENT DOCUMENTS 4,205,456 A * 6/1980 Ayers ..... F26B 23/005 34/515
4,502,229 A 3/1985 Kitzman
2013/0014404 A1 1/2013 Bloemendaal

FOREIGN PATENT DOCUMENTS

GB 2199644 A * 7/1988 ..... F26B 17/126

* cited by examiner

*Primary Examiner* — Jessica Yuen
(74) *Attorney, Agent, or Firm* — Jason T. Daniel, Esq.; Daniel Law Offices, P.A.

(57) ABSTRACT

A grain dryer includes a housing having a top end, a bottom end, and a plurality of walls that define an interior space. A grain funnel is positioned along the top end of the main housing, and a grain discharge member is positioned along the bottom end of the housing. One or more HVAC units are provided. Each of the HVAC units including an electrically powered compressor, a fan, a condenser, an expansion valve, and an evaporator that are each connected by a set of refrigerant pipes that are filled with a refrigerant material. Hot air generated by the HVAC units is supplied to a plurality of supply vents positioned along the main housing, and cold air generated by the HVAC units is supplied to a plurality of return vents positioned along the main body at a location adjacent to the discharge member.

9 Claims, 3 Drawing Sheets

HVAC GRAIN DRYER

TECHNICAL FIELD

The present invention relates to continuous flow grain dryers, and more particularly to a grain dryer that utilizes an HVAC system.

BACKGROUND

The statements in this section merely provide background information related to the present disclosure and may not constitute prior art.

When grains are harvested they must undergo a drying process before being utilized or stored for seed. As such, companies typically utilize some type of high-capacity continuous-flow grain drying system, such as those described in U.S. Pat. No. 4,502,229 and U.S. Patent Publication No. 2013/0014404, for example, the contents of each of which are incorporated herein by reference.

Such systems typically include a vertical tank or other such structure having a hollow interior space through which grains flow. As the grains pass through the tank, hot air generated by one or more high temperature (typically gas) burners is channeled into the main body to dry the grains before they exit the bottom of the structure. Owing to the moisture/humidity present within the tank, such burners must operate at extremely high temperatures to thoroughly dry the wet grain.

Although such systems have been utilized for several years, the use of high temperature gas burners is known to produce tremendous amounts of CO2 emissions which are harmful to the environment and contribute to global warming. Moreover, such burners are inefficient, as the hot air they produce is simply vented out of the top of the structure and in to the surrounding environment. To this end, the use and operation of these burners represents a significant expense to system operators in terms of the amount of energy/fuel needed to continuously power these burners. Finally, owing to the extremely high temperatures produced by the burners, it is not uncommon for the heat distribution within the tank to be uneven and to cause a significant portion of the grain to become burned and/or fractured, thereby reducing the quality of the amount of crop that can be sold at a premium.

Accordingly, it would be beneficial to provide an improved grain dryer system that utilizes one or more energy efficient heating ventilation and air conditioning (HVAC) units to dehumidify and dry the grain, thereby alleviating the above noted problems.

SUMMARY OF THE INVENTION

The present invention is directed to a grain dryer. One embodiment of the present invention can include a continuous feed grain housing having a top end, a bottom end, and a plurality of walls that define an interior space. A funnel for receiving grain can be positioned along the top end, and a grain discharge member can be provided along the bottom end.

In one embodiment, grain passing through the main housing can be heated by one or more HVAC units. Each of the HVAC units can include an electrically powered compressor, a fan, a condenser, an expansion valve, and an evaporator that are each connected by a set of refrigerant pipes that are filled with a refrigerant material. The generated hot air can be supplied to a plurality of supply vents positioned along the main housing.

In one embodiment, the HVAC units can also dehumidify the air within the tank, and can generate cold air. The generated cold air can be supplied to a plurality of return vents positioned along the main body at a location adjacent to the discharge member.

In another embodiment, a plurality of inverted V-shaped grain diverters can be positioned along the inside of the main housing at locations above and adjacent to the supply vents and return vents.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
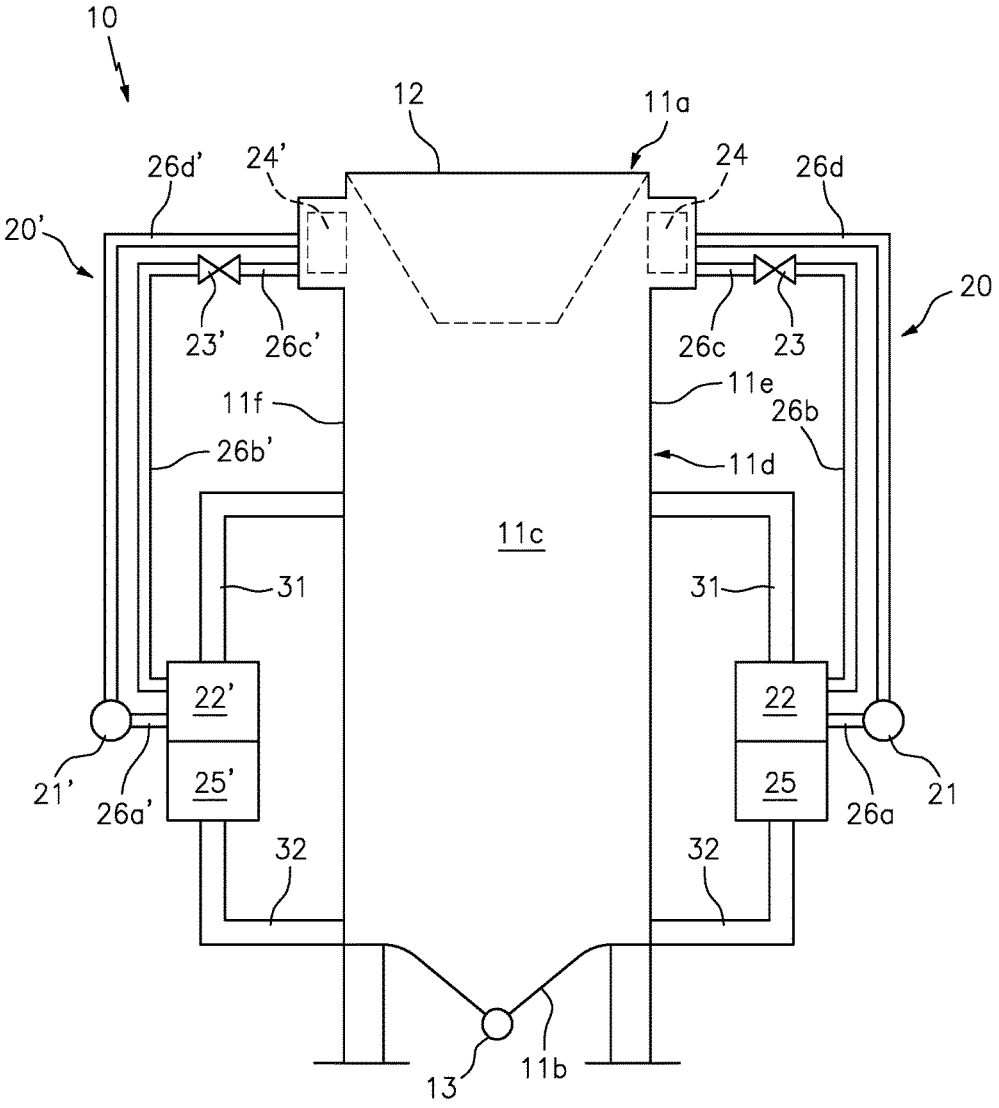
FIG. 1 is a frontal view of the HVAC grain dryer that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Figure 2:
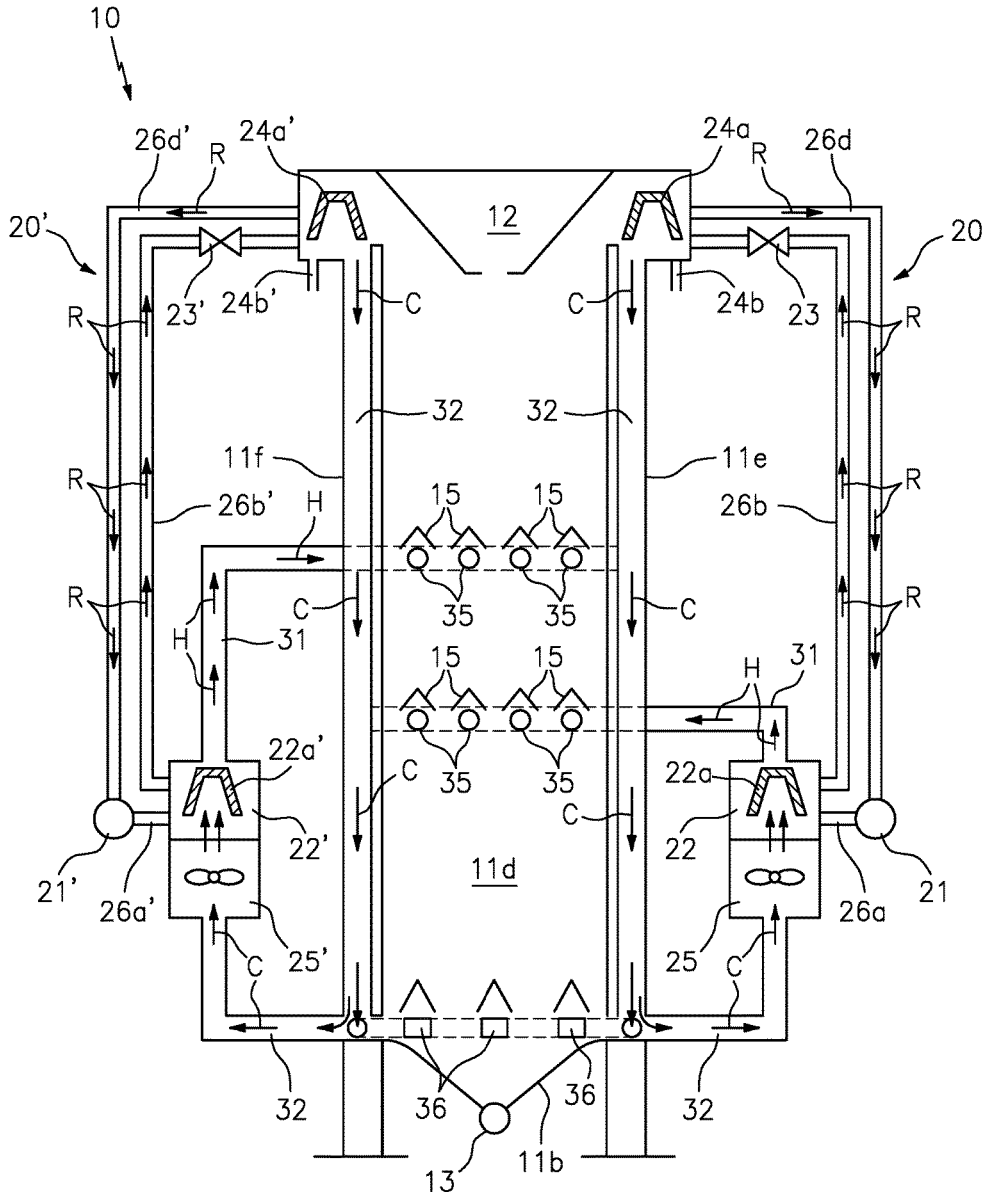
FIG. 2 is a front view of the HVAC grain dryer where the front wall of the main housing is removed for ease of illustration, in accordance with one embodiment of the invention.
Figure 3:
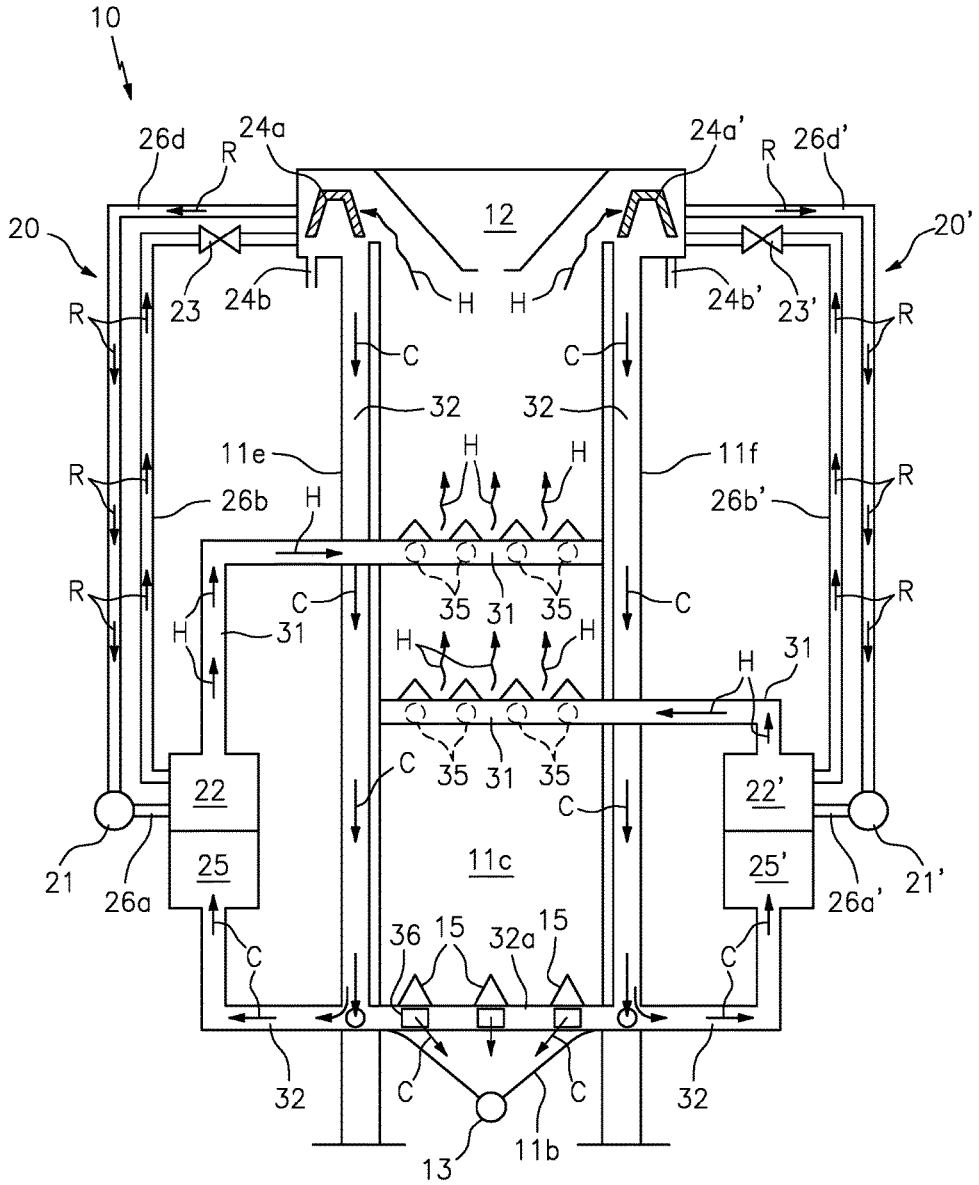
FIG. 3 is a rear view of the HVAC grain dryer where the back wall of the main housing is removed for ease of illustration, in accordance with one embodiment of the invention.

FIGS. 1-3 illustrate one embodiment of a HVAC grain dryer 10 that is useful for understanding the inventive concepts disclosed herein. As will be described below, the inventive dryer is designed to utilize highly efficient HVAC units in conjunction with a grain conveyance device (e.g., continuous flow grain dryer body) to evenly and efficiently dry grains in an environmentally friendly manner.

As shown, in FIG. 1, the dryer 10 can include a grain conveyance device in the form of a main housing 11 having a top end 11*a*, a bottom end 11*b*, a front wall 11*c*, a back wall 11*d*, an end wall 11*e* and an opposite end wall 11*f*, each forming an interior space. A funnel 12 can be disposed along the top end 11*a* and can preferably extend within the interior space of the main body. As will be described below, the angled bottom end of the funnel can act to direct the hot air passing upward through the grains back into the HVAC unit(s) for energy recapture by the same. In this regard, the funnel 12 serves the dual purpose of receiving grain, and directing hot air H inside the main body towards the below described evaporator units. Finally, the main body can also include a grain discharge member 13 having a valve or other such device along the bottom end of the tank for selectively discharging the grain.

As described herein, the main body can be constructed from any number of suitable materials such as steel, for example, and can be constructed to include any number of different shapes and sizes, as would traditionally be utilized for continuous-flow grain dryers. To this end, the housing 11 is intended to be illustrative in nature, and not limiting, as other embodiments are contemplated wherein an existing grain conveyance device can be retrofitted to include the heat channeling features of the funnel 12, and the below described HVAC units.

The dryer 10 can include any number of HVAC units which can act to dehumidify the air within the tank, and to directly impart hot and cold air to grains or other such material passing through the main body. Although described below with regard to particular locations along the main body and/or as utilizing two HVAC units, this is for illustrative purposes only. As such, the inventive concepts disclosed herein contemplate the use of any number of different HVAC units, which can be positioned along any portion of the main body to account for elements such as the size of the grain dryer body, the volume of grain to be passed therethrough and/or the moisture level of the resulting grains to be achieved.

To this end, one such HVAC unit 20 will be described below; however, as shown in the drawings, any number of additional HVAC unit(s) 20' can also be provided. For ease of description, the illustrated HVAC unit 20' and subcomponents 21', 22', 22*a*', 23', 24' 24*a*', 25', and 26*a*'-26*d*' can include identical elements and functionality to those described below with regard to HVAC 20 and subcomponents 21, 22, 22*a*, 23, 24, 24*a*, 25, and 26*a*-26*d*, respectively.

In the preferred embodiment, the HVAC unit 20 can include an electrically powered compressor 21, a condenser 22, an expansion valve 23 and an evaporator 24, that are each connected via refrigerant pipes, which serve as refrigerant paths forming a refrigerant circuit. The refrigerant pipes can preferably be constructed from copper or steel pipes, for example, and can be insulated along their outside surfaces.

As shown best in FIG. 2, wherein a portion of the main body is removed for illustration, the compressor 21 of the HVAC unit acts as a refrigerant pump which moves refrigerant R, such as Freon, for example, through each of the refrigerant paths of the refrigerant circuit. In this regard, the compressor functions in the expected manner to compress the refrigerant between a gas and liquid state. The compressor is connected to the condenser 22 via a first refrigerant path 26*a*.

The condenser 22 is connected to the expansion valve 23 via a second refrigerant path 26*b*. The condenser includes a plurality of coils which create an air-refrigerant heat exchanger. As such, a fan 25 is positioned adjacent to the condenser and functions to pull cold air C from the return duct 32 and over the condenser coils 22*a*. When this air passes over the coils, the heat within the refrigerant is expelled and heats the air. This hot air H is then carried by supply duct 31 to a plurality of supply vents 35 located within the interior space of the main body housing.

The expansion valve 23 is connected to the evaporator via a third refrigerant path 26*c*. The expansion valve functions to remove pressure from the liquid refrigerant to allow expansion of state from liquid to a vapor in the evaporator.

As shown best in FIG. 3, wherein the back wall 11*d* is removed for ease of illustration, the evaporator 24 is connected to the compressor 21 via a fourth refrigerant path 26*d*. The evaporator also includes a plurality of coils which create an air-refrigerant heat exchanger. To this end, the hot air H that was released into the tank body is deflected/pulled toward the evaporator where it passes over the evaporator coils 24*a*. During this process, the coils absorb the heat from the hot air and deposit the same into the refrigerant R. At this time, moisture that was removed from the air is transferred into clean water which can be expelled by the main body via drains 24*b*, and used for any desirable purpose.

Once the heat is removed, the resulting cold air C is deposited into an evaporator duct 32. As shown, the lower end of the duct 32 can terminate into the condenser 22, and a return branch 32*a* can be provided to funnel a portion of the cold air C into the bottom portion of the main body via return vents 36. In the preferred embodiment, return branch 32*a* can extend between the left and right side ducts 32 so as to equalize the return air for both HVAC units 20 and 20', respectively. Such a feature offering improved performance of the system and allowing the system to cool the grains before they are discharged from the main body.

In one embodiment, a plurality of inverted V-shaped diverters 15 can be positioned above each of the vents 35 and 36, and can extend from the front wall 11*c* to the back wall 11*d*. To this end, as wet grain is deposited into the main body via the funnel 12, the grain passes along the sides of the diverters where the open bottom ends allow the hot air H and cold air C produced by the HVAC units to interact with the grain, thereby imparting a drying and cooling force onto the same.

Accordingly, by replacing traditional inefficient gas burners with one or more HVAC systems as described above, the inventor has discovered a novel and energy efficient way to dry grains, without the resulting high costs and harmful environmental effects. By dehumidifying the air, the present system is capable of utilizing much lower heat during the drying process to eliminate fracturing of the grains, thereby yielding a higher quality product.

As described herein, one or more elements of the grain dryer 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof. As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A grain dryer, comprising:

a main housing that includes a top end, a bottom end, and a plurality of walls that define an interior space;

at least one HVAC unit that is in communication with the main housing, said HVAC unit being configured to generate hot air, cold air, and perform a dehumidifying process within the main housing;

a plurality of supply vents that are disposed along at least one of the plurality of main housing walls, each of said supply vents being connected to one of the at least one HVAC units to discharge the generated hot air into the interior space of the main housing;

a plurality of return vents that are disposed along at least one of the plurality of main housing walls, each of said supply vents being connected to at least one of the at least one HVAC units to discharge the generated cold air into the interior space of the main housing, wherein said return vents are positioned beneath the plurality of supply vents along a major axis of the main body; and a plurality of inverted V-shaped channels that extend transversely between two of the plurality of walls within the main housing at locations above and adjacent to each of the plurality of return vents and supply vents.

2. The grain dryer of claim 1, wherein the at least one HVAC unit includes a first HVAC unit that comprises:

an electrically powered compressor, a condenser, an expansion valve, and an evaporator that are each connected by a set of refrigerant pipes that are filled with a refrigerant material.

3. The grain dryer of claim 2, further comprising:

a funnel that is disposed along the top end of the main housing, and includes an angled surface positioned within the interior portion of the main housing, wherein the evaporator is positioned along the top end of the main body at a location adjacent to the funnel, and the angled surface is configured to direct the generated hot air into the evaporator.

4. The grain dryer of claim 3, further comprising:

an evaporator duct that extends along the major axis of the main body and is in communication with the evaporator along a top end and the condenser along a bottom end, said duct functioning to supply the generated cold air from the evaporator to the condenser.

5. The grain dryer of claim 4, further comprising a return branch that is interposed between the duct and the return vents.

6. The grain dryer of claim 2, wherein the at least one HVAC unit includes a second HVAC unit that comprises:

a second electrically powered compressor, a second condenser, a second expansion valve, and a second evaporator that are each connected by a second set of refrigerant pipes filled with a second refrigerant material.

7. The grain dryer of claim 6, further comprising:

a funnel that is disposed along the top end of the main housing, and includes an angled surface positioned within the interior portion of the main housing, wherein the first evaporator and the second evaporator are positioned along the top end of the main body at a location adjacent to the funnel, and the angled surface is configured to direct the generated hot air into the first and second evaporators.

8. The grain dryer of claim 7, further comprising:

a first evaporator duct that extends along the major axis of the main body and is in communication with the first evaporator along a top end and the first condenser along a bottom end; and a second evaporator duct that extends along the major axis of the main body and is in communication with the second evaporator along a top end and the second condenser along a bottom end, wherein the first and second evaporator ducts are configured to supply the generated cold air from the first and second evaporators to the first and second condensers, respectively.

9. The grain dryer of claim 8, further comprising:

a return branch that is in communication with each of the first evaporator duct, the second evaporator duct and the return vents.

* * * * *